US006447359B1

(12) United States Patent
Crump

(10) Patent No.: US 6,447,359 B1
(45) Date of Patent: Sep. 10, 2002

(54) MEMORIAL NOVELTY DOLL DEVICE HAVING INTEGRAL SOUND PRODUCING MEANS AND KIT AND METHOD FOR CUSTOMIZING THE SAME

(76) Inventor: Carlos D. B. Crump, 2221Wentwood Valley Dr. #8, Little Rock, AR (US) 72212

( * ) Notice: Subject to any disclaimer, the term of this patent is extended or adjusted under 35 U.S.C. 154(b) by 0 days.

(21) Appl. No.: 09/921,981

(22) Filed: Aug. 3, 2001

(51) Int. Cl.[7] ..... A63H 3/36

(52) U.S. Cl. ..... 446/100; 446/321; 446/337; 446/256

(58) Field of Search ..... 434/256, 100; 446/97, 99, 100, 101, 321, 337, 338, 339, 341, 343, 297, 302, 175

(56) References Cited

U.S. PATENT DOCUMENTS 3,210,884 A * 10/1965 Sharff et al. ..... 446/100
4,017,905 A 4/1977 Convertine et al.
4,696,653 A 9/1987 McKeefery
4,840,602 A 6/1989 Rose
4,857,030 A 8/1989 Rose
4,923,428 A 5/1990 Curran
5,468,172 A 11/1995 Basile
5,480,337 A * 1/1996 Baker ..... 446/100
5,738,561 A 4/1998 Pracas
5,816,821 A 10/1998 Ovellette et al.
6,000,987 A 12/1999 Belin et al.
6,165,569 A * 12/2000 Cohen ..... 40/411
6,183,338 B1 * 2/2001 Mallette ..... 446/321

* cited by examiner

*Primary Examiner*—Jacob K. Ackun
(74) *Attorney, Agent, or Firm*—John D. Gugliotta

(57) ABSTRACT

A doll is provided that is custom designed to resemble a specific person, either living or dead. These characteristics of sex, hair color and style, eye color and the like are selected from a group of various characteristics. A tape-recording mechanism provides for the recording of the represented person's voice, if still living, or for the recording of voices by friends or relatives, if deceased.

5 Claims, 4 Drawing Sheets

MEMORIAL NOVELTY DOLL DEVICE HAVING INTEGRAL SOUND PRODUCING MEANS AND KIT AND METHOD FOR CUSTOMIZING THE SAME

RELATED APPLICATIONS

The present invention was first described in Disclosure Document Number 473,677 filed on May 4, 2000. There are no previously filed, nor currently any co-pending applications, anywhere in the world.

BACKGROUND OF THE INVENTION

1. Field of the Invention

The present invention relates generally to novelty doll devices and the like and, more particularly, to a memorial novelty doll device having integral sound producing means and a kit and method for customizing the same.

2. Description of the Related Art

The reality of death is something we all must face. While the pain associated with losing a loved one usually fades with time, so do the pleasant memories as well. The favorite sayings, memories, frequent expressions and the general life events that define an individual are thought of only when viewing a photo album, or reminiscing with friends and family members. Such times happen less frequently as the years go by. While audio and tape recordings help as well, they are usually not handy and very seldom played back. Often, younger descendants of the deceased were not even born yet when they died. These people have little to go on when trying to figure out what type of person the deceased was, other than family stories and maybe a few pictures. Many of these same problems occur with living family members who live a distance away and are infrequently seen.

A search of the prior art did not disclose any patents that read directly on the claims of the instant invention; however, the following references were considered related.

The following patents disclose a miniature tape recorder incorporated in a doll.

U.S. Pat. No. 6,000,987 issued in the name of Belin et al.

U.S. Pat. No. 5,738,561 issued in the name of Pracas

U.S. Pat. No. 5,468,172 issued in the name of Basile

U.S. Pat. No. 4,017,905 issued in the name of Convertine et al.

The following patents describe a speaking toy doll responding by touch or voice recognition.

U.S. Pat. No. 4,923,428 issued in the name of Curran

U.S. Pat. No. 4,840,602 issued in the name of Rose

U.S. Pat. No. 4,696,653 issued in the name of McKeefery

U.S. Pat. No. 5,816,821 issued in the name of Ouellette et al. discloses a bilingual educational doll.

U.S. Pat. No. 4,857,030 issued in the name of Rose describes two or more dolls with speech synthesizing systems.

Consequently, there is a need for a means by which a deceased person's memories can be revived on a frequent basis, yet with dignity and respect

SUMMARY OF THE INVENTION

It is therefore an object of the present invention to provide an improved memorial novelty doll device having integral sound producing means.

It is a feature of the present invention to provide a method for individually customizing such an improved memorial novelty such as to render a visually similar characterization of a deceased individual during a memorial service.

Briefly described according to one embodiment of the present invention, the memorial doll is a doll that is custom designed to resemble a specific person, either living or dead. Upon initial observation, the invention resembles a conventional doll that is approximately 16" tall with a base diameter of three to four inches. After closer inspection however, it can be seen that the physical characteristics of the doll are customized to match a specific person. These characteristics are envisioned to be body shape characteristics, hair color and style, eye color, clothing, and the like. A tape-recording mechanism, either located in the base or the rear of the invention, provides for the recording of the represented person's voice, if still living, or for the recording of voices by friends or relatives, if deceased. The recording comments are envisioned to be that of favorite memories, expressions, sayings, etc. associated with the represented individual.

The use of the memorial doll allows for the representation of a living person or a means for descendants to remember a deceased member of the family in a respectful manner while keeping past memories alive.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
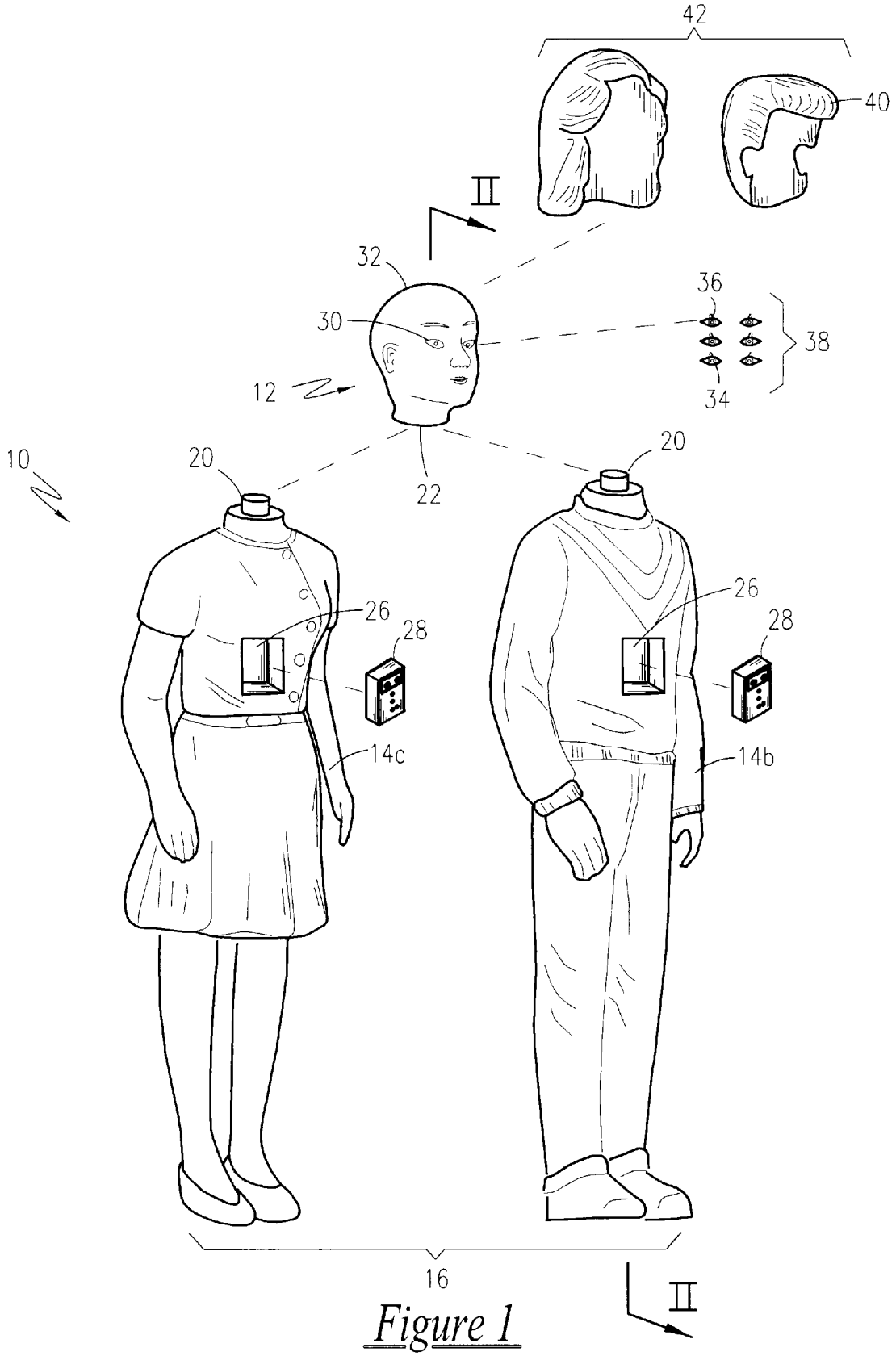
FIG. 1 is a perspective view of a memorial novelty doll device having integral sound producing means according to a typical representation of the present invention.
Figure 2:
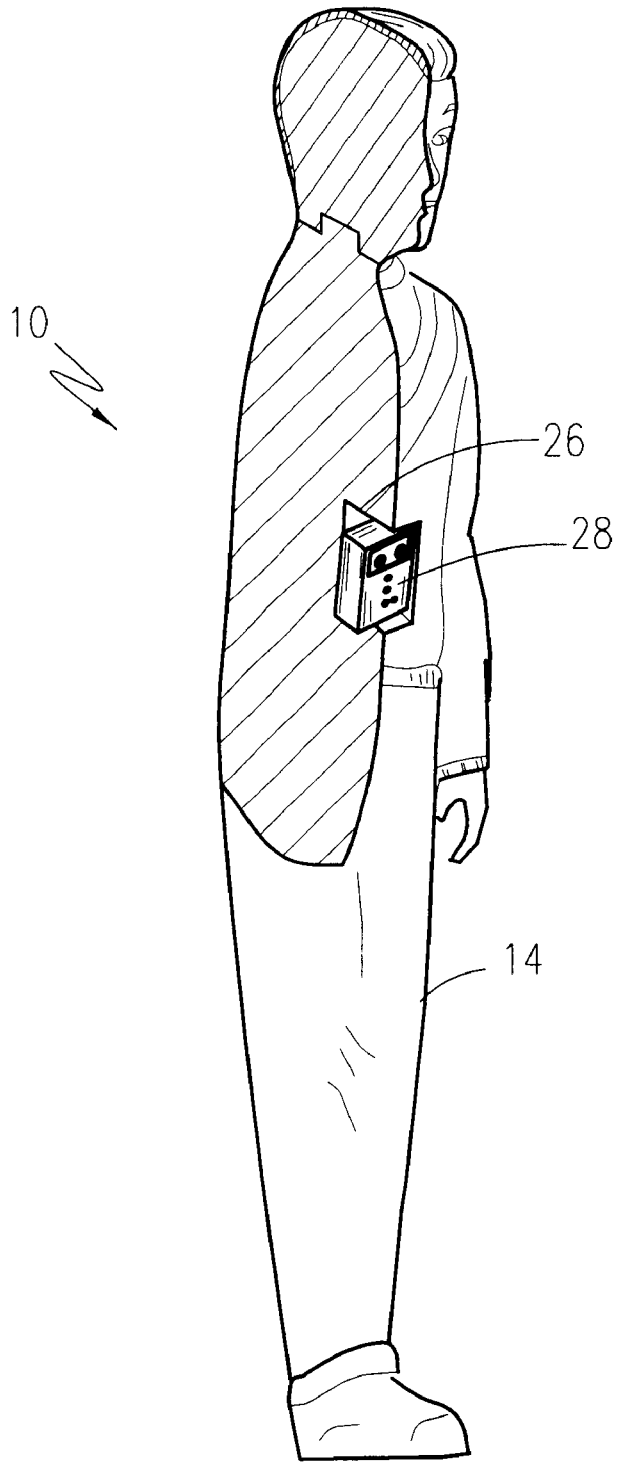
FIG. 2 is a sectional view of FIG. 1 taken along line II—II.

Referring now to FIG. 1–2, a memorial novelty doll device 10 and associated customizing kit, as will be described herein, is shown, according to the present invention. The use of the memorial doll allows for the representation of a living person or a means for descendants to remember a deceased member of the family in a respectful manner while keeping past memories alive. As such, provisions are made as to render a visually similar characterization of a deceased individual during a memorial service. To accomplish this, the doll 10 is comprised of a head 12 and a body 14. The body 14 is selected from a body group 16 comprising a generic male body 14*a* an a generic female body 14*b*. Each body 14 within the body group 16 includes a head attachment means 20 of a common design for allowing the head 12 to attach thereto via a body receiving means 22. Further, each body 14 within the body group 16 forms a receiving cavity 26 for receiving an internal recording means 28 of a design described in greater detail below.

Further, the head 12 is selected from a head group (not shown) comprising a series of generic head forms having various shades of external color to simulate various skin tones available within the general population. However, each head 12 includes an eye receiving means 30 and a hair attachment means 32. Affixable within the eye receiving means 30 are eyes 34, each having an eye attachment means 36, and selected from an eye group 38 comprising blue eyes, brown eyes, green eyes, and black eyes. The hair attachment means 32 is affixable to a hair element 40 selected from a hair group 42 comprising brown hair, black hair, and blonde hair, each available in curly or straight and long or short configurations.

Figure 3:
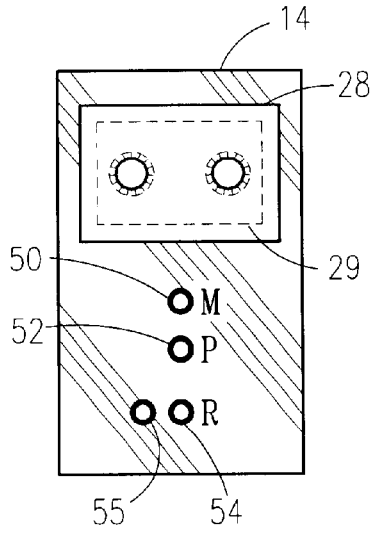
FIG. 3 is a partial front elevational view of a recording means for use therewith.
Figure 4:
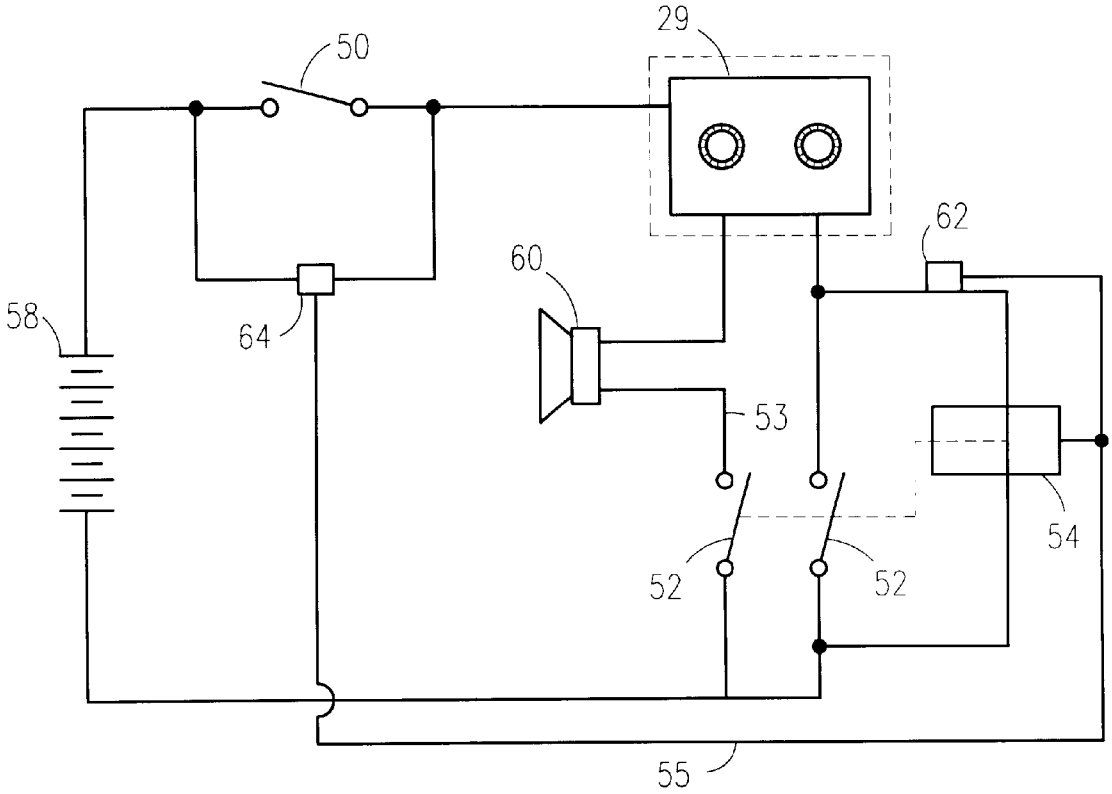
FIG. 4 is a schematic wiring diagram of said recording means for use therewith.

Referring now to FIGS. 3–4, the internal recording means 28 is described in greater detail. The internal recording means 28 is envisioned as a tape-recording mechanism, either located in the base or the rear of the invention, provides for the recording of the represented person's voice, if still living, or for the recording of voices by friends or relatives, if deceased. The recording comments are envisioned to be that of favorite memories, expressions, sayings, etc. associated with the represented individual. The internal recording means 28 is capable of detachably receiving one of a plurality of audio tapes 29 for either playing or recording. Conventional pressure actuated on/off switches 50, 52, 54 and 55 are mounted to the exterior of the body 14. The control circuit 56 includes a battery 58, is directly connected to control switch 50 which in turn is directly connected to tape deck 28 to provide power for either playing or recording. A sound emitting speaker 60 is directly connected to the tape deck 28 and will broadcast the contents of the tape 29 whenever double pole "play" switch 52 and master switch 54 are closed. Switch 52 should be ganged or operatively connected to record switch 54 by link 53 so that when one switch is closed, the other switch is open. Control LED's (not shown) can be used in conjunction with switches 50, 52, 54, and 55 so that each switch will be lighted when it is closed.

When it is desired to go to the record mode, switch 54 is closed, and the receiver 62 will cause a sound to be recorded on the tape 29. An internal voice actuation switch 64 capable of bypassing switches 50 and closing switch 54 when the switch 50 is open, when responder 62 picks up the noise, is operative when automatic switch 55 is closed.

2. Operation of the Preferred Embodiment

Figure 5:
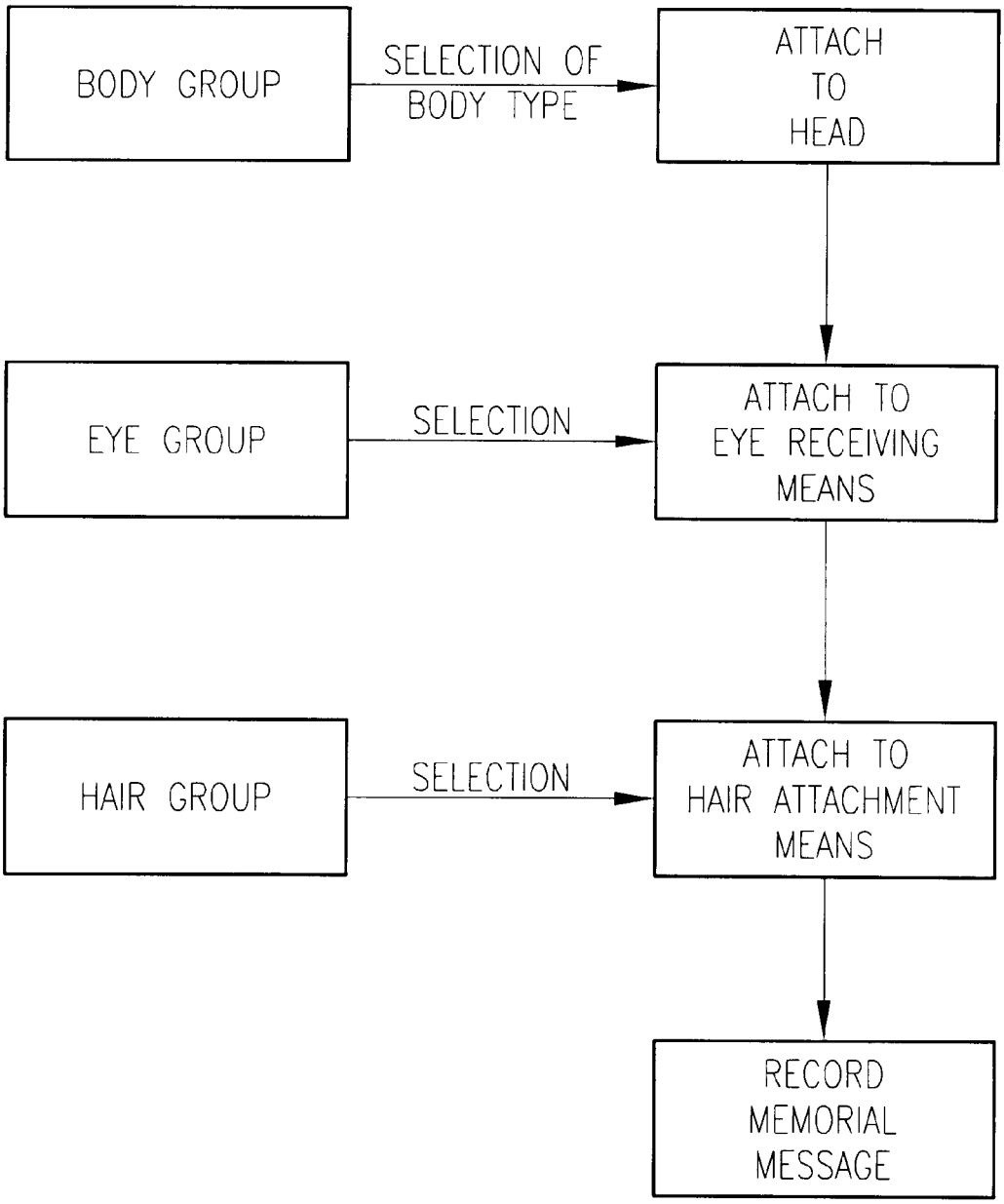
FIG. 5 is a block diagram describing a method for customizing the same.

In accordance with a preferred embodiment of the present invention, as shown in FIG. 5, a means by which a deceased person's memories can be revived on a frequent basis, yet with dignity and respect can be utilized. Based upon the physical characteristics of the individual to be memorialized, a body 14 is selected to match from the body group 16. Upon attachment of a head 12 having coloring designed to match the physical characteristics of the individual to be memorialized, selection and attachment of eyes 34 from the eye group 36 to the eye receiving means 30 is completed to further match the physical characteristics of the individual to be memorialized. Finally, hair 40 is selected from the hair group 42 to match the physical characteristics of the individual to be memorialized, and a message is recorded to represent the person's voice, if still living, or for the recording of voices by friends or relatives, if deceased. The recording comments are envisioned to be that of favorite memories, expressions, sayings, etc. associated with the represented individual.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A memorial novelty doll device and customizing kit comprising:

a head having a body receiving means and n eye receiving means and a hair attachment means;

a body group comprising a generic male body an a generic female body, each said body within the body group including a head attachment means for attachment to said body receiving means, each body within said body group further forms a receiving cavity;

an internal recording means for attachment within said receiving cavity.

2. The memorial novelty doll device and customizing kit of claim 1, wherein said head is selected from a head group comprising a series of generic head forms having various shades of external color to simulate various skin tones available within the general population.

3. The memorial novelty doll device and customizing kit of claim 1, further comprising eyes having an eye attachment means and selected from an eye group comprising blue eyes, brown eyes, green eyes, and black eyes.

4. The memorial novelty doll device and customizing kit of claim 1, further comprising a hair element for attaching to said hair attachment means and selected from a hair group comprising brown hair, black hair, and blonde hair, with each available in curly or straight and long or short configurations.

5. The memorial novelty doll device and customizing kit of claim 1, wherein said the internal recording means comprises a tape-recording mechanism, either located in the base or the rear of the invention, provides for the recording.

* * * * *